US010183823B2

(12) United States Patent
Laws et al.

(10) Patent No.: US 10,183,823 B2
(45) Date of Patent: Jan. 22, 2019

(54) LIFT MECHANISMS

(71) Applicant: Hewlett-Packard Development Company, L.P., Houston, TX (US)

(72) Inventors: Alexander David Laws, Vancouver, WA (US); Manilo Samuel Castillo Rios, Corvallis, OR (US); Kyle Loucks, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/775,993

(22) PCT Filed: Mar. 18, 2016

(86) PCT No.: PCT/US2016/023187

§ 371 (c)(1),
(2) Date: May 14, 2018

(87) PCT Pub. No.: WO2017/160312

PCT Pub. Date: Sep. 21, 2017

(65) Prior Publication Data

US 2018/0297799 A1 Oct. 18, 2018

(51) Int. Cl.
*B65H 3/06* (2006.01)

(52) U.S. Cl.
CPC ..... *B65H 3/0684* (2013.01); *B65H 3/0661* (2013.01); *B65H 2404/1521* (2013.01)

(58) Field of Classification Search
CPC ..... B65H 3/0684; B65H 2404/1521; B65H 3/0661; G03G 15/6511
USPC ..... 271/117, 118
See application file for complete search history.

(56) References Cited

U.S. PATENT DOCUMENTS

| | | | | |
|---|---|---|---|---|
| 4,186,662 | A | 2/1980 | Borneman | |
| 4,688,958 | A | 8/1987 | Tajima | |
| 4,961,655 | A | 10/1990 | Saito | |
| 5,193,797 | A * | 3/1993 | Harada | B65H 3/0669 271/115 |
| 5,443,252 | A | 8/1995 | Morinaga et al. | |
| 5,447,382 | A | 9/1995 | Yui et al. | |
| 6,244,588 | B1 | 6/2001 | Tsubakimoto et al. | |
| 6,382,619 | B1 | 5/2002 | Gustafson et al. | |
| 6,422,773 | B1 | 7/2002 | Lim | |
| 7,963,519 | B2 * | 6/2011 | Bokelman | B65H 3/0684 271/117 |
| 8,118,299 | B2 * | 2/2012 | Sato | B65H 3/0684 271/117 |
| 8,915,495 | B2 | 12/2014 | Jariabka et al. | |
| 2004/0161280 | A1 | 8/2004 | Lee et al. | |
| 2007/0104529 | A1 | 5/2007 | Chen | |

* cited by examiner

*Primary Examiner* — Michael C McCullough
(74) *Attorney, Agent, or Firm* — HP Inc. Patent Department

(57) ABSTRACT

In an example, a lift mechanism may include a linkage to engage with a pick arm, a crank switchably disposed in a first position and a second position, and a swingarm to move the crank from the first position to the second position. The linkage may move the pick arm from a raised position to a lowered position when the crank moves from the first position to the second position.

15 Claims, 12 Drawing Sheets

LIFT MECHANISMS

BACKGROUND

Imaging systems may print, scan, copy, or perform other actions with media. Further, imaging systems may include feeding or picking systems to load the media and deliver or drive the media through the imaging system for performing operations on or with the media. The imaging systems may scan the media for markings or patterns, deposit printing fluid, such as ink, or another printing substance, such as three-dimensional printing powder, on the media, and/or may produce duplicates of the media, including markings or patterns thereon, in addition to other functions.

DETAILED DESCRIPTION

Figure 1A:
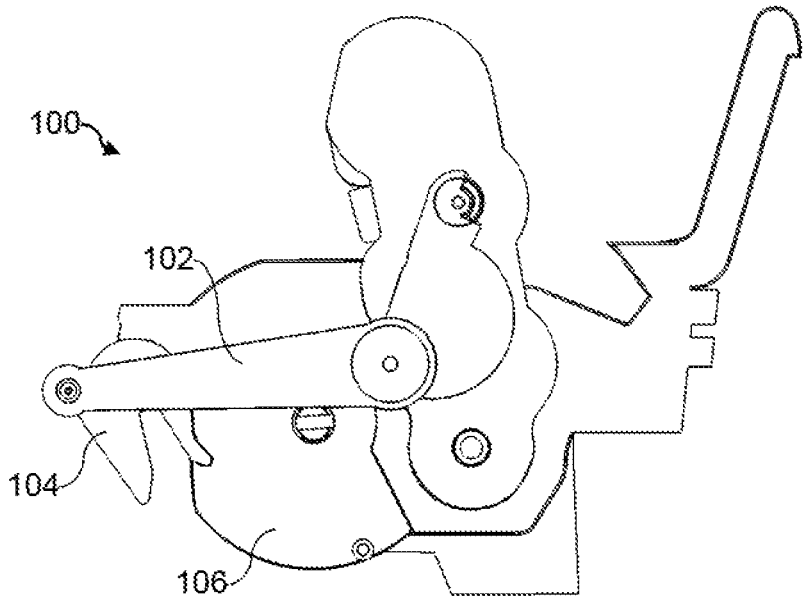
FIG. 1A is a side view of an example lift mechanism.

Imaging systems may include scanning systems, copying systems, printing systems, or other systems that perform actions on or with media, sometimes referred to as print media. Scanning systems may optically or electrically scan print media. Scanning systems may also be used in conjunction with printing systems. Printing systems may deposit printing fluid, such as ink, or another printing substance, such as three-dimensional printing powder, on media. The scanning system may be integrated with the printing system, or disposed separately from the printing system. Additionally, in some situations, the scanning system and/or printing system may be part of, engaged with, or used in conjunction with a copying system. In such a system, the scanning system may scan media, followed by the copying system producing a duplicate of the media based on the scan conducted by the scanning system. The copying system may produce the duplicate by utilizing the printing system to deposit print substance on media in the same manner or patterns as on the scanned media.

The scanning system, copying system, printing system, or other imaging system may include a pick system, which, in some situations, may also or alternatively be referred to as a feed system or a load system. The pick system may pick up and load media, or, in other words, pick up and deliver or drive the media through a media path of the corresponding imaging system. In some situations, the pick system may include pick rollers to pick the media in the imaging system. The pick rollers may exert a normal force on the media in order to create friction in between the pick rollers and the media, such that the rollers may pick the media. Such a normal force exerted by the pick rollers may make loading or refilling media into the imaging system difficult, due to the friction in between the media and the pick rollers. Thus, it may be desirable in some situations to separate the pick system from the media loading area during loading or refilling operations. Separating the pick system from the loading area, or moving the pick system away, or otherwise increasing the distance between the pick system and the loading area may make loading media into the imaging system easier by reducing or eliminating the friction or normal force between the pick system, or rollers therein, and the media being loaded into the imaging system.

In some situations, imaging devices may increase the distance between the pick system and the media loading area, thereby enabling the friction-free insertion or loading of media into the imaging system, by moving or lowering the media loading area or a media tray away from the pick system. Moving the entire media loading area away from the pick system may use a relatively high amount of power from the imaging device. Further, such a system may use a relatively complex mechanical mechanism having many parts and, therefore, may be relatively expensive and complicated to implement into an imaging device.

Implementations of the present disclosure provide a lift mechanism for a feed system of an imaging device that utilizes a relatively small amount of parts, and may be implemented in such a way as to use a relatively low amount of power from the imaging device. In some implementations, the lift mechanism may be referred to as a lift or lifting device. Examples of the lift mechanism disclosed herein may increase the distance between a pick system of an imaging device and a media loading area of such an imaging device. Increasing the distance between such components may decrease or remove friction exerted by the pick system upon the media being inserted into the loading area.

Figure 1B:
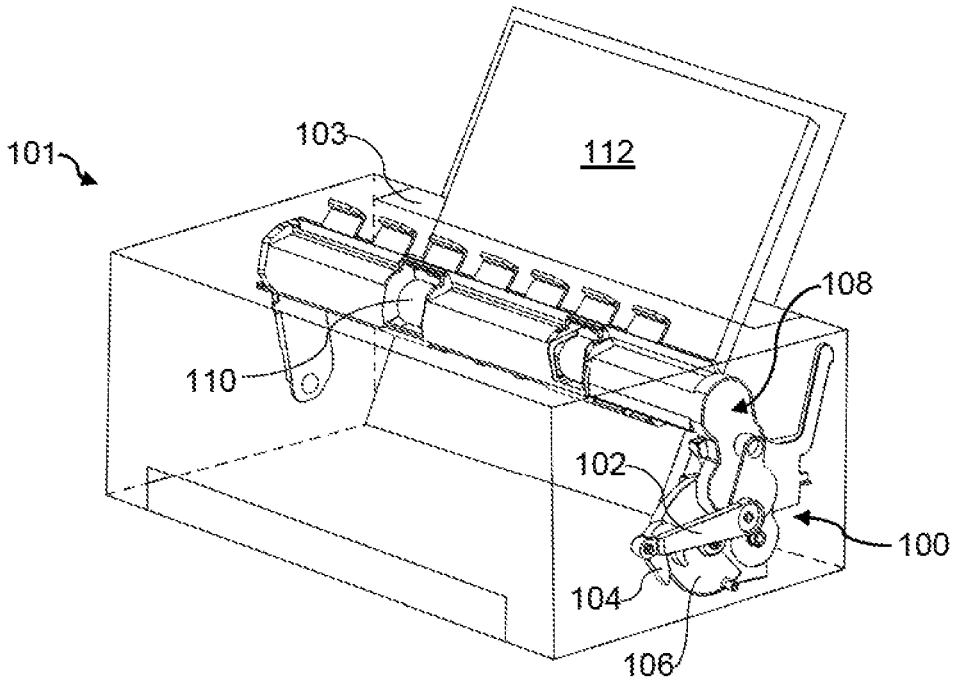
FIG. 1B is a perspective view of an example imaging system having an example lift mechanism.

Referring now to FIG. 1A, a side view of an example lift mechanism 100 is illustrated. The example lift mechanism 100 may include a linkage 102, a crank 104, and a swingarm 106. Referring additionally to FIG. 1B, a perspective view of an example imaging device 101 having an example lift mechanism 100 therein is illustrated. In some implementations, the example imaging device 101 may include any of or any combination of a printer, a scanner, and/or a copier, or any other imaging device. In some implementations, the imaging device 101 may receive media or print media 112 within a media loading slot or area 103. Note, in the illustrated example, the imaging device 101 features a top-in, front-out media insertion orientation, wherein media 112 is inserted or loaded into the imaging device 101 in a vertical or semi-vertical orientation. It should be noted, however, that other insertion orientations for the media 112 are possible with implementations of the present disclosure, such as horizontal insertion orientations, or loading the media 112 into the imaging device using a media tray or other method, for example. Further, any imaging device including an example lift mechanism 100 as described herein may have a structure, orientation, or appearance that may be similar to or differ from the imaging device 101 illustrated in FIG. 1B.

In some implementations, the example lift mechanism 100 may include a pick arm 108. The pick arm 108 may be used to pick media 112 and deliver the media 112 through a media path of the imaging device 101. As used herein, pick or picking media may refer to the pick system of the imaging device 101, or a pick arm 108 thereof, taking media from a loading area 103 of the imaging device 101 and delivering the media through the imaging device 101. In some implementations, the media 112 may be picked from a stack of media 112 that has been loaded into the imaging device 101. The media 112 may be paper, cardboard, card stock, photo paper, or another suitable media for use in the imaging device. In some implementations, the pick arm 108 may include a pick roller 110, or multiple pick rollers 110 to pick the media 112 or a piece of the media 112 for delivery through the imaging device 101.

Figure 2A:
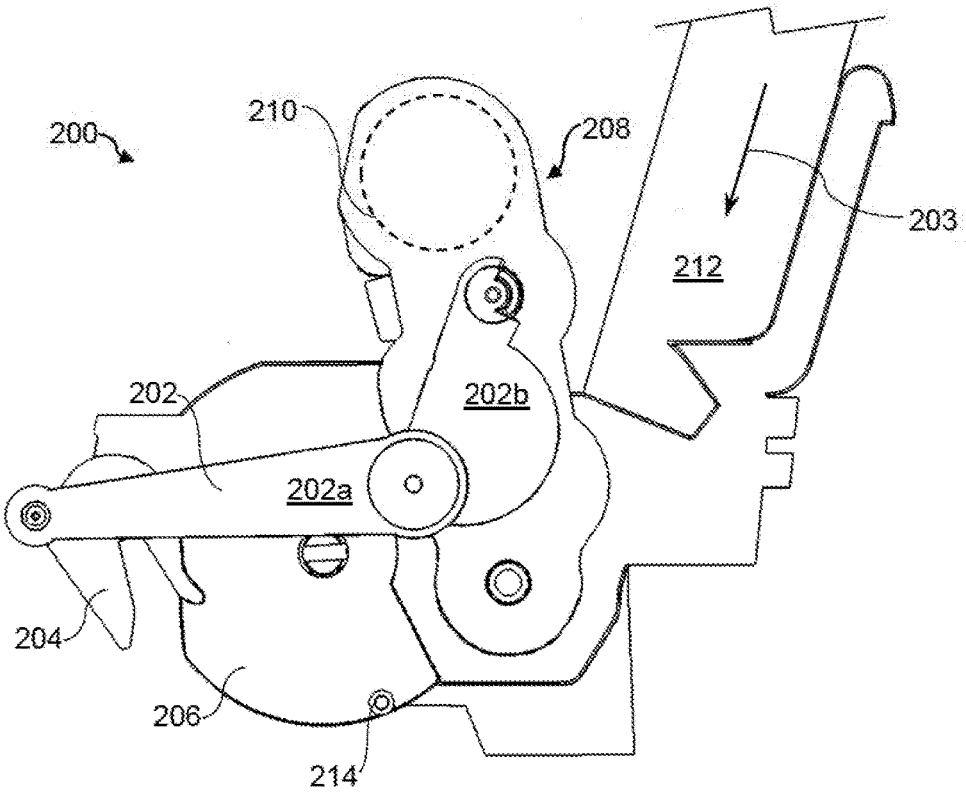
FIG. 2A is a side view of an example lift mechanism.

Referring now to FIG. 2A, a side view of an example lift mechanism 200 is illustrated. Example lift mechanism 200 may be similar to example lift mechanism 100. Further, the similarly named elements of example lift mechanism 200 may be similar in function and/or structure to the elements of example lift mechanism 100, as they are described above. In some implementations, lift mechanism 200 may include a linkage 202, a crank 204, and a swingarm 206. The lift mechanism 200 may include, or may engage with a pick arm 208 of an imaging device. The pick arm 208, in some implementations, may pick media 212 and deliver the media 212 through a media path of the imaging device. The pick arm 208, in some implementations, may include components to pick and deliver the media 212, such as a pick roller 210, or multiple pick rollers 210, for example. Pick roller 210 is illustrated in phantom lines because the pick roller or pick rollers 210, in this example, may be disposed on the other side of the pick arm 208, or behind other components. The media 212 may be loaded into the imaging device along example direction 203, in some implementations. In other implementations, the media 212 may be inserted or loaded into the imaging device along another direction. Additionally, the media 212 may be loaded into the imaging device in a stacked orientation, or as part of a ream of media 212. In other implementations, the media 212 may be loaded in a rolled fashion, or as part of a roll of media 212.

The pick arm 208 may be a movable or pivotable component wholly or partially disposed within the imaging device. Further, the pick arm 208 may be movable or pivotable between a first or raised position, and a second, or lowered position. FIG. 2A illustrates the pick arm 208 in the raised position. When disposed in the raised position, the pick arm 208, or pick rollers 210, or other picking components thereof, may be separated from the media 212 loaded within the imaging device, such that the pick arm 208, or picking components therein, do not exert a normal force on the media 212, and thereby do not create friction between the pick arm 208 and the media 212. If the imaging device is empty of media 212, the pick arm 208 may be separated from the loading area or a media tray when disposed in the raised position, such that a user or another component of the imaging device may load media 212 into the media loading area, for example, along direction 203.

The lift mechanism 200 may also include a linkage 202. The linkage 202 may be a rigid or semi-rigid component mechanically linking the pick arm 208 with a crank 204 of the lift mechanism 200. In some implementations, the linkage 202 may include a single arm or link, whereas, in other implementations, the linkage 202 may include more than a single link or arm. In other words, in some implementations, the linkage 202 may act as a single link in a 4-bar linkage, and in other implementations, the linkage 202 may act as two links in a 5-bar linkage. In other implementations, the linkage 202 may include a different number of bars, or a different structure. In the example implementation illustrated in FIG. 2A, the linkage 202 may include a lower or first portion or arm 202*a* and an upper or second portion or arm 202*b*. The lower and upper portions 202*a* and 202*b* may be rigidly connected or engaged with each other such that the portions cannot move relative to one another. In other implementations, the lower and upper portions 202*a* and 202*b* may be movable relative to one another in only one direction, or in multiple directions.

The lift mechanism 200 may also include a crank 204. The crank 204 may be a movable or rotatable component relative to the lift mechanism 200 and/or the pick arm 208. Further, the crank 204 may be switchably disposed in, or movable from a first position to a second position, and vice versa. The crank 204 is illustrated as being disposed in the first position in FIG. 2A. The crank 204 may be engaged with the linkage 202 either directly, or through other intermediary components. In some implementations, the linkage 202 may provide a direct mechanical link between the crank 204 and the pick arm 208 such that, when the crank 204 is disposed in the first position, the linkage 202 moves or disposes the pick arm 208 in the raised position, as illustrated in FIG. 2A. In other implementations, the linkage 202 may mechanically link the crank 204 and the pick arm 208 using additional or intermediary components, arms, linkages, or other mechanical elements.

The lift mechanism 200 may also include a swingarm 206. The swingarm 206 may be a movable or rotatable component, relative to the other components of the lift mechanism 200, the pick arm 208, or the imaging device. In some implementations, the swingarm 206 may be engaged with a feed shaft, drive shaft or other drive element of a feed system of the imaging device, or another drive element of the imaging device, such that the drive element may rotate the swingarm 206. In other implementations, the swingarm 206 may be engaged with a standalone drive element not engaged with other components of the imaging device. The drive element may be rigidly connected to the swingarm 206, or connected through friction alone, such as in a press-fit engagement. In some implementations, the swingarm 206 may be engaged with the drive element through additional or intermediary components, such as a gear or transmission, for example. The drive element may use a motor or other motive device to drive or rotate the swingarm 206 in a first direction and in a second direction. The drive element may drive the swingarm 206 in order for the swingarm 206 to engage with the crank 204. In some implementations, the swingarm 206 may be driven in the first direction such that the swingarm 206 engages with the crank 204 and moves, rotates, or transitions the crank 204 from the first position to the second position. In further implementations, the swingarm 206 may be driven in the second direction such that the swingarm 206 engages with the crank 204 and moves the crank 204 from the second position to the first position.

Figure 2B:
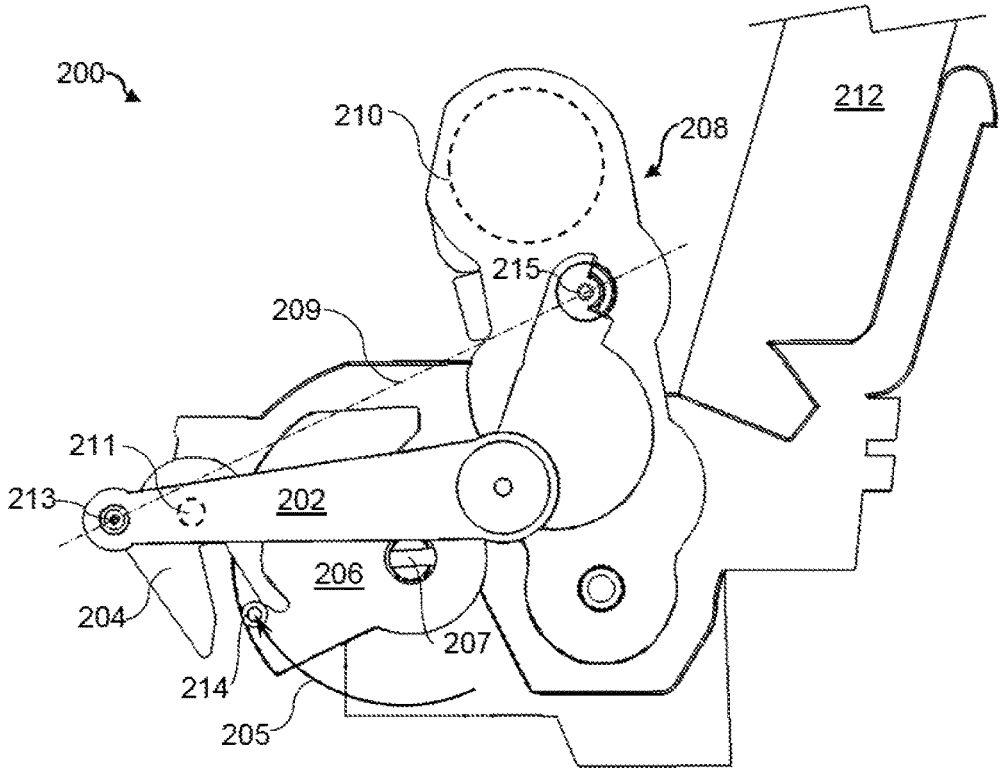
FIG. 2B is a side view of an example lift mechanism.

Referring now to FIG. 2B, a side view of an example lift mechanism 200 is illustrated wherein the crank 204 is in the first position, and, thus, the pick arm 208 is in the raised position, similar to FIG. 2A. FIG. 2B illustrates the swingarm 206 as having been moved in the first direction to the point where the swingarm 206 engages with the crank 204. In FIG. 2B, the first direction is illustrated by directional arrow 205. The swingarm 206, in some implementations, may include a post 214 to engage with the crank 204 and rotate the crank 204. Further, the crank 204 may include a complementary slot to receive and engage with the post 214 such that the crank 204 moves from the first position to the second position, and vice versa. In some implementations, the post 214 and the slot of the crank 204 may engage with each other in a similar fashion to a Geneva Drive. The drive element may have rotated the swingarm 206, and thus the post 214, in the first direction 205, about an axis or point of rotation 207, to the point where the post 214 comes into contact with the slot of the crank 204, but before the crank 204 has started to move. Therefore, the crank 204 is disposed in the first position, thereby disposing the pick arm 208, via the linkage 202, in the raised position. In some implementations, the pick arm 208 may be locked in the raised position when the crank 204 is in the first position. The pick arm 208 may be locked in the raised position such that an outside force may not be able to manually push or otherwise move the pick arm to the lowered position, and the pick arm 208 may not accidentally fall or move to the lowered position, when the crank 204 is in the first position. The crank 204 may lock the pick arm 208 in the raised position, as illustrated in FIG. 2B, when an axis 209, defined by a first point of rotation 213 and a second point of rotation 215 of the linkage 202, is disposed past a point of rotation 211 of the crank 204. The first point of rotation 213 may be the point of engagement between the linkage 202 and the crank 204, while the second point of rotation 215 may be the point of engagement between the linkage 202 and the pick arm 208, in some implementations. The pick arm 208 may be mechanically prevented from moving to the lowered position until such an axis 209 crosses over the point of rotation 211 of the crank 204, as illustrated in FIGS. 2C-D.

Figure 2C:
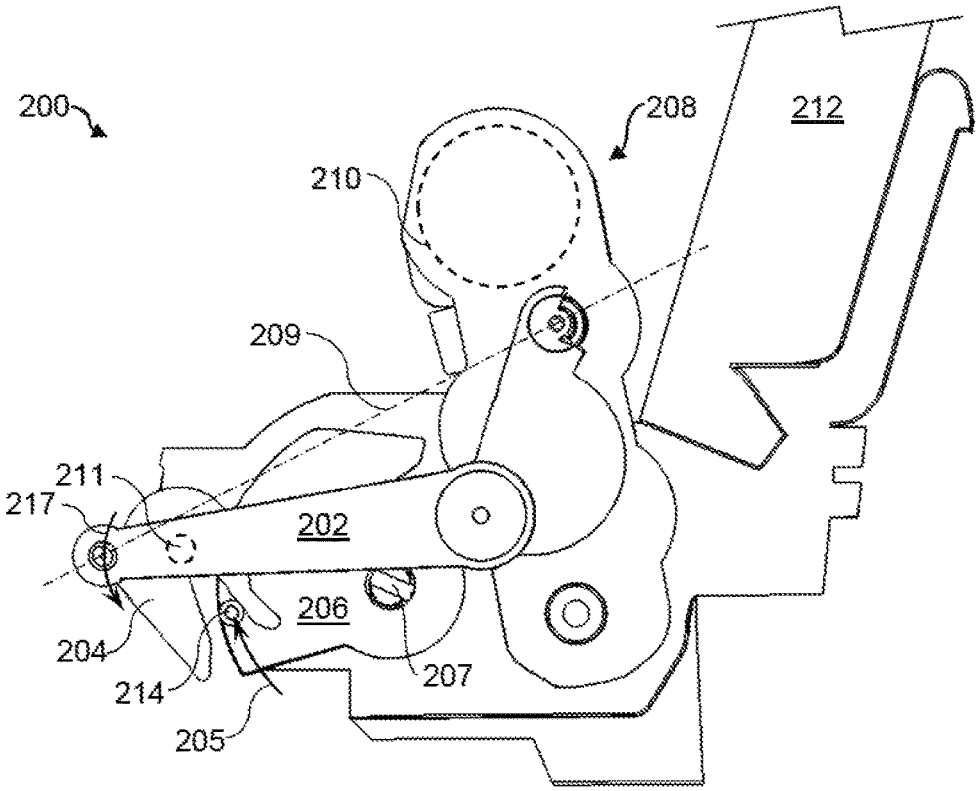
FIG. 2C is a side view of an example lift mechanism.

Referring now to FIG. 2C, a side view of an example lift mechanism 200 is illustrated, wherein the crank 204 has begun to move, rotate, or transition from the first position to the second position. The drive element has continued to move the swingarm 206 along first direction 205 so that the post 214 of the swingarm 206 continues to engage with the slot of the crank 204, thereby rotating the crank 204 about its point of rotation 211 along direction 217. The crank 204 has not moved along direction 217 to such a degree so as to move the axis 209 across the point of rotation 211, so the pick arm 208 may still be locked in the raised position, as described above.

Figure 2D:
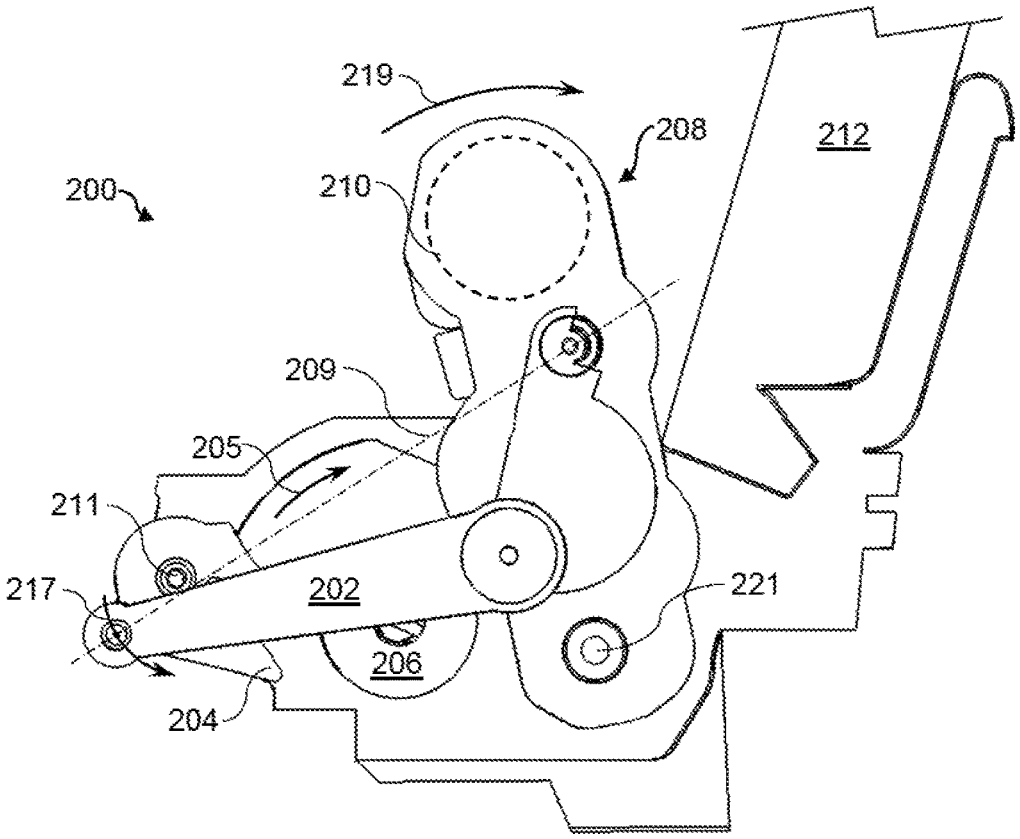
FIG. 2D is a side view of an example lift mechanism.

Referring now to FIG. 2D, a side view of an example lift mechanism 200 is illustrated, wherein the pick arm 208 has started to move or transition from the raised position to the lowered position. The drive element has continued to move the swingarm 206 along first direction 205 so that the post 214 of the swingarm 206 continues to engage with the slot of the crank 204, thereby rotating the crank 204 about its point of rotation 211 along direction 217. In this Figure, the post 214 and the slot are both hidden behind the linkage 202, and are not visible. Further, the crank 204 has moved along direction 217 to such a degree so as to move the axis 209 beyond the point of rotation 211 of the crank 204. Therefore, the pick arm 208 is no longer locked in the raised position, and the linkage may move the pick arm 208, by the connection between the crank 204 and the linkage 202, from the raised position towards the lowered position, along direction 219, about a point of rotation 221. The pick arm 208 may move along direction 219 towards media 212.

Figure 2E:
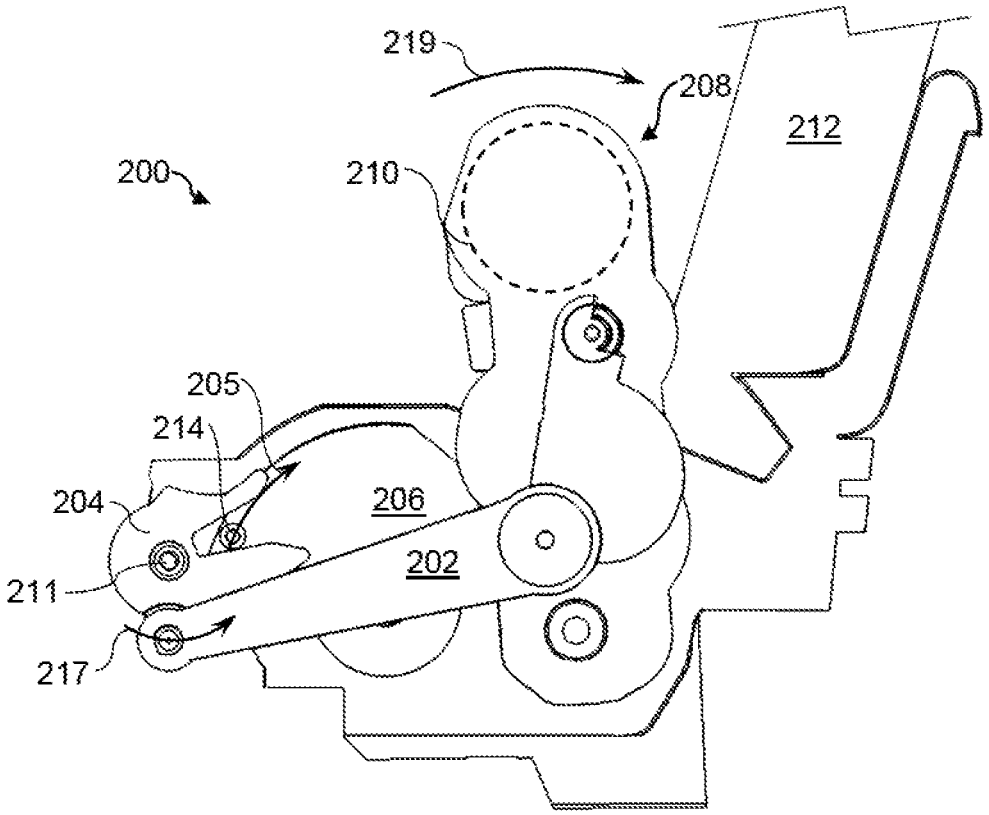
FIG. 2E is a side view of an example lift mechanism.

Referring now to FIG. 2E, a side view of an example lift mechanism 200 is illustrated, wherein the pick arm 208 has continued to move towards the lowered position, and, thus, towards media 212. The drive element has continued to move the swingarm 206 along first direction 205 so that the post 214 of the swingarm 206 continues to engage with the slot of the crank 204, thereby rotating the crank 204 about its point of rotation 211 along direction 217. Such a movement of the crank 204 may move the linkage 202 such that the linkage 202, accordingly, moves the pick arm 208 along direction 219 towards the lowered position, and, thus, the media 212.

Figure 2F:
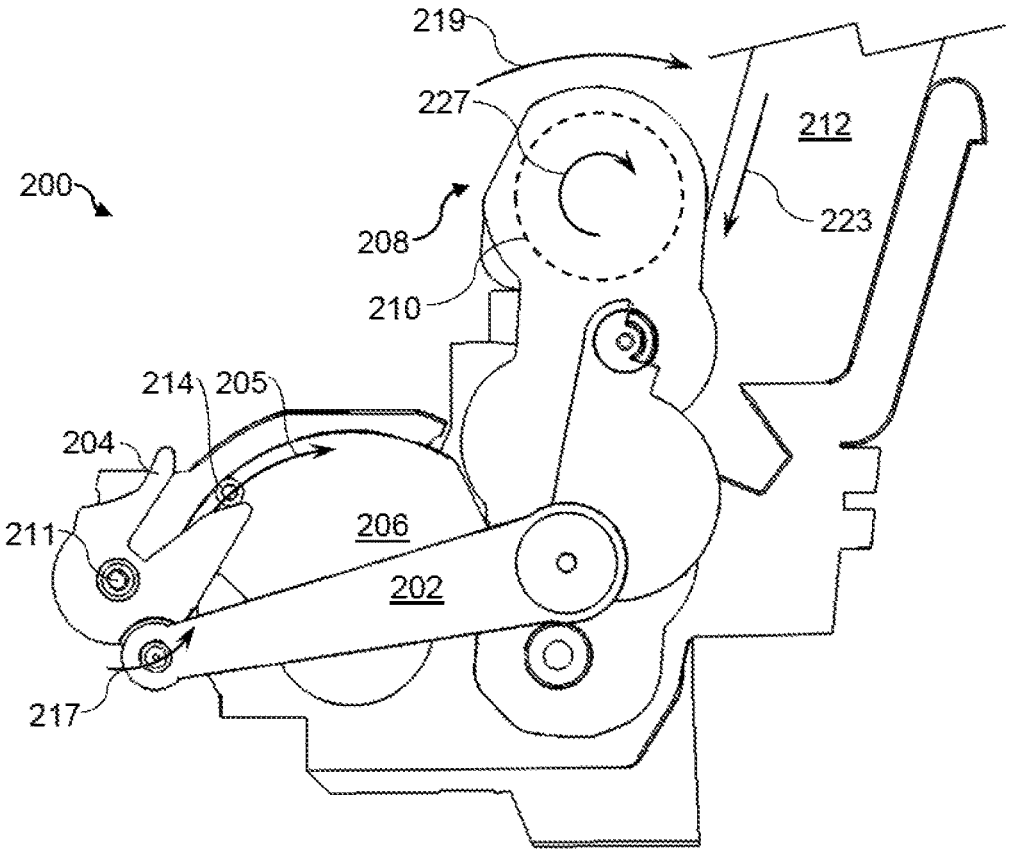
FIG. 2F is a side view of an example lift mechanism.

Referring now to FIG. 2F, a side view of an example lift mechanism 200 is illustrated, wherein the pick arm 208 has fully transitioned from the raised position to the lowered position. The drive element has continued to move the swingarm 206 along first direction 205 so that the post 214 of the swingarm 206 continues to engage with the slot of the crank 204, thereby rotating the crank 204 about its point of rotation 211 along direction 217. The crank 204 has fully moved from the first position to the second position. As such, the linkage 202 has fully moved the pick arm 208 along direction 219 to the lowered position. The pick arm 208 may now be engaged with the media 212. The pick arm 208, pick rollers 210, or other picking components of the pick arm 208 may now be exerting a normal force upon the media, such that the pick arm 208 may pick the media, or a single piece of media from a stack, for example, and drive or deliver the media through a media path of the imaging device. In this example, a portion of the media path may be represented by an example directional arrow 223. In order to pick the media 212, once the pick arm 208 is disposed in the lowered position, the imaging system may rotate a pick roller 210 or other component of the pick arm 208 along a direction 227 in order to drive media 212 through the media path.

After an amount of media 212 has been picked and delivered through the media path by the lift mechanism 200 and the feed system of the imaging device, the imaging device may move or transition the pick arm 208 from the lowered position to the raised position, and may lock the pick arm 208 therein. In order to move the pick arm 208 to the raised position, the above-described actions may be substantially reversed. In other words, the drive element may move the swingarm 206 along a second direction, opposite that of the first direction 205, so that the post 214 of the swingarm 206 engages with the slot of the crank 204, thereby rotating the crank 204 about its point of rotation 211 along a direction opposite to that of direction 217. The post 214 may engage with the crank 204 until the crank 204 fully moves from the second position (illustrated in FIG. 2F) to the first position (illustrated in FIGS. 2A-B). Throughout the transition of the crank 204 from the second position to the first position, the engagement of the crank 204 with the linkage 202 may cause the linkage 202 to pull on or move the pick arm 208 from the lowered position (engaged with the media 212) to the raised position (separated or apart from the media 212). Further, the swingarm 206 may continue to engage with and move the crank 204 until the axis 209 crosses over the point of rotation 211 of the crank 204, thereby mechanically locking the pick arm 208 in the raised position. Although a mechanical locking system is described herein, it should be noted that the imaging device may include another separate device, alone or in conjunction with the mechanical locking system, to lock the pick arm 208 in the raised position.

In some implementations, the default state of the lift mechanism 200 may be to dispose the pick arm 208 in the raised position. In other words, the pick arm 208 may always be in the raised position, until the imaging device receives instruction or input to perform a process on media 212. The imaging device may then perform the above functions in order to lower the pick arm 208 to the lowered position to pick media 212. Once the desired operations or processes have been performed on the media 212, or the desired quantity of media 212 has been delivered through the media path, the imaging device may raise the pick arm 208 back up to the raised position. In other implementations, the default state of the lift mechanism 200 may be to dispose the pick arm 208 in the lowered position, always engaged with media 212 and ready to pick media 212. The pick arm 208 may not be moved to the raised position until a specific instruction to do so is received by the imaging device. Such a specific instruction may be from a sensor detecting depletion of the media 212, for example, and the pick arm 208 may then be raised to the raised position so that media 212 may be loaded into loading area of the imaging device.

Figure 3A:
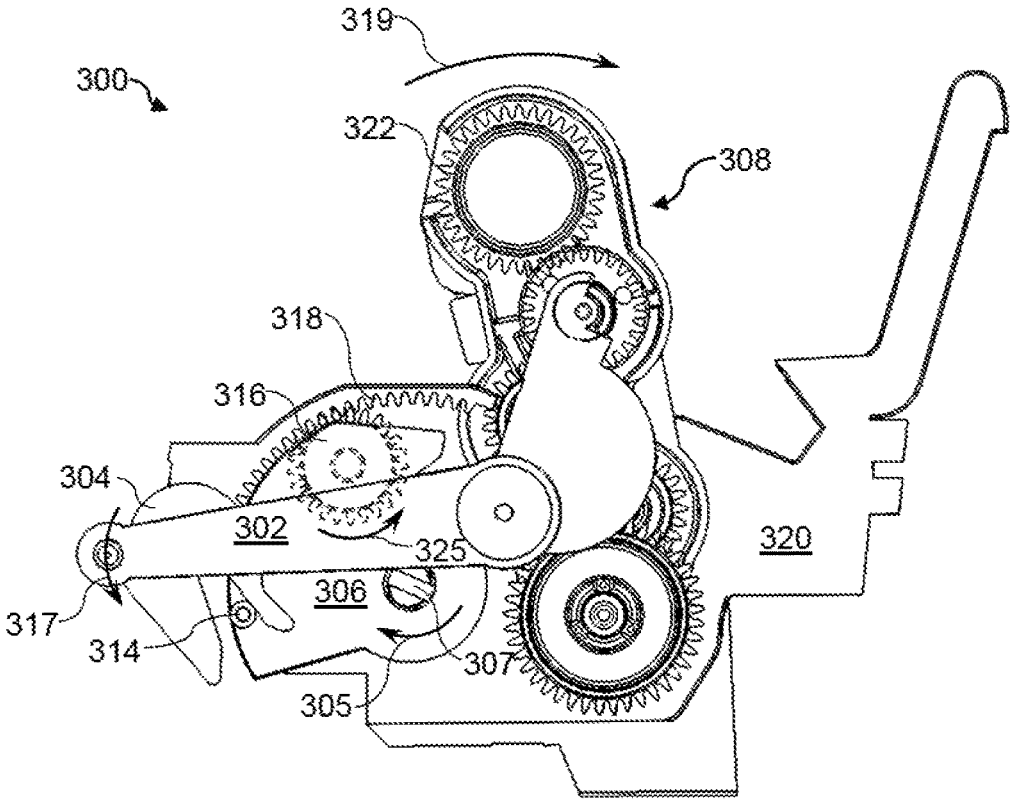
FIG. 3A is a side view of an example lift mechanism.

Referring now to FIG. 3A, a side view of an example lift mechanism 300 is illustrated. Example lift mechanism 300 may be similar to example lift mechanism 100 or 200. Further, the similarly named elements of example lift mechanism 300 may be similar in function and/or structure to the elements of example lift mechanism 100 or 200, as they are described above. In some implementations, the example lift mechanism 300 may include a linkage 302, a crank 304, and a swingarm 306, and the lift mechanism 300 may move a pick arm 308 along a direction 319 from a raised position to a lowered position, and vice versa. The lift mechanism 300 may also include a planetary gear 316 and a ring gear 318, in some implementations. The planetary gear 316 may be engaged with or rotatably connected to the swingarm 306 such that the planetary gear 316 is capable of rotating relative to the swingarm 306. The planetary gear 316 may be disposed on the swingarm 306 radially outwards from a point of rotation 307 of the swingarm 306 such that, as the swingarm 306 rotates about the point of rotation 307, the planetary gear 316 may travel with the swingarm 306 about the point of rotation 307, for example, along a first direction 305.

The lift mechanism 300 may also include a ring gear 318, in some implementations. The ring gear 318 may be a stationary set or array of gear or cog teeth, having a complementary teeth pitch to that of the planetary gear 316. Further, the ring gear 318 and the swingarm 306 may be concentric to one another, or in other words, the ring gear 318 may have a center point of curvature that coincides with the point of rotation 307 of the swingarm 306. Additionally, the planetary gear 316 may be radially disposed from the point of rotation 307 an appropriate distance such that the planetary gear 316 may operably engage with the ring gear 318. Therefore, the planetary gear 316 and the ring gear 318 may be able to mesh together such that the planetary gear 316 may travel along the ring gear 318. In some implementations, the planetary gear 316 may engage with the ring gear 318 in a manner other than meshing teeth. For example, the planetary gear 316 and the ring gear 318 may each engage each other with a friction surface, such as a surface with a rough, rubberized, or other appropriate surface having a high coefficient of friction, such that the planetary gear 316 may travel along the ring gear 318. In further implementations, the ring gear 318 may be stationary and disposed on or part of a housing or other non-moving structural component 320 of the imaging device.

Figure 3B:
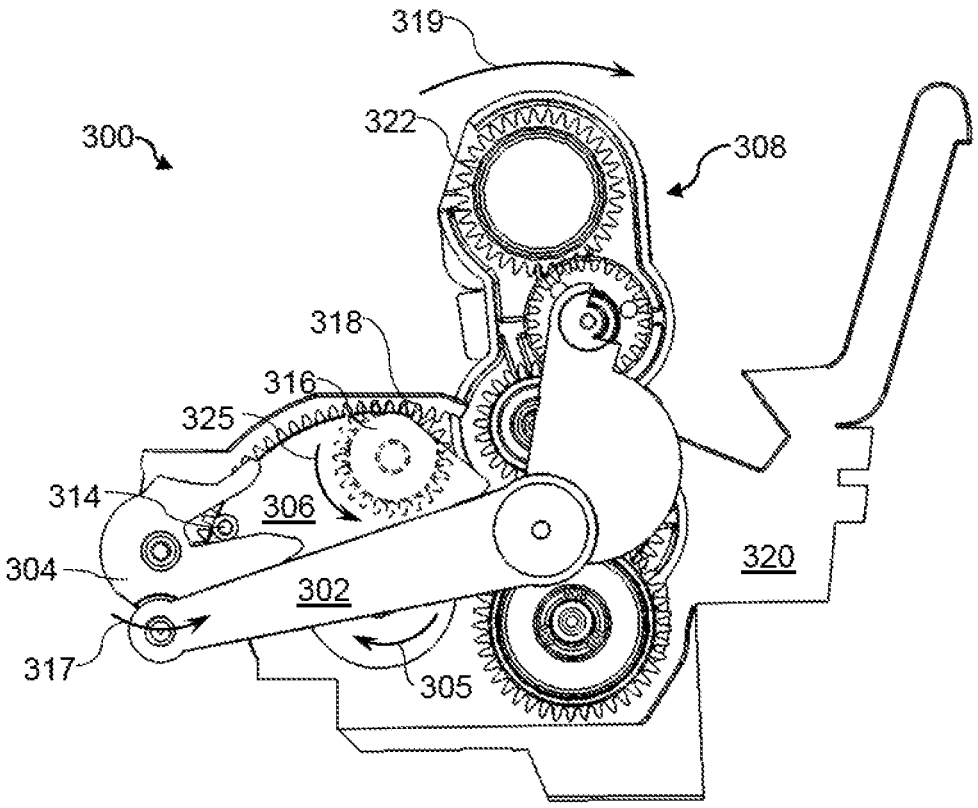
FIG. 3B is a side view of an example lift mechanism.

In some implementations, a drive element may drive or move the swingarm 306 in the first direction 305 such that the swingarm 306 engages with the crank 304. The swingarm 306 may have a post 314 to engage with the crank 304 such that the crank 304 rotates in a direction 317 from a first position to a second position. In some implementations, the drive element may also operably engage with the planetary gear 316 so that, as the drive element rotates the swingarm along first direction 305, the drive element also drives the planetary gear 316 in a direction 325. In further implementations, another component or a separate drive element may drive the planetary gear 316. Further, the planetary gear 316 may be indirectly driven by a drive element, such as through intermediary gears, transmissions, or other components, in some implementations. The planetary gear 316 may be rotated in direction 325 such that the teeth of the planetary gear 316 engage or mesh with the teeth of the ring gear 318, and the planetary gear 316 moves along first direction 305. The planetary gear 316, through its connection with the swingarm 306, may move the swingarm 306 in the first direction 305 as the planetary gear 316 moves along first direction 305. Therefore, in an example where the swingarm 306 is not rigidly connected to the drive element, but only connected through friction, the planetary gear 316 may assist in rotating the swingarm 306 in the first direction 305 with enough torque such that the swingarm 306 is able to engage with and rotate the crank 304 from the first position to the second position. Referring additionally to FIG. 3B, a side view of example lift mechanism 300 is illustrated, wherein the planetary gear 316 and the swingarm 306 have partially moved along the first direction 305, thereby partially moving the crank 304 along direction 317 from the first position to the second position. The crank 304, by way of the linkage 302, has, therefore, partially moved the pick arm 308 along direction 319 towards the lowered position.

Figure 3C:
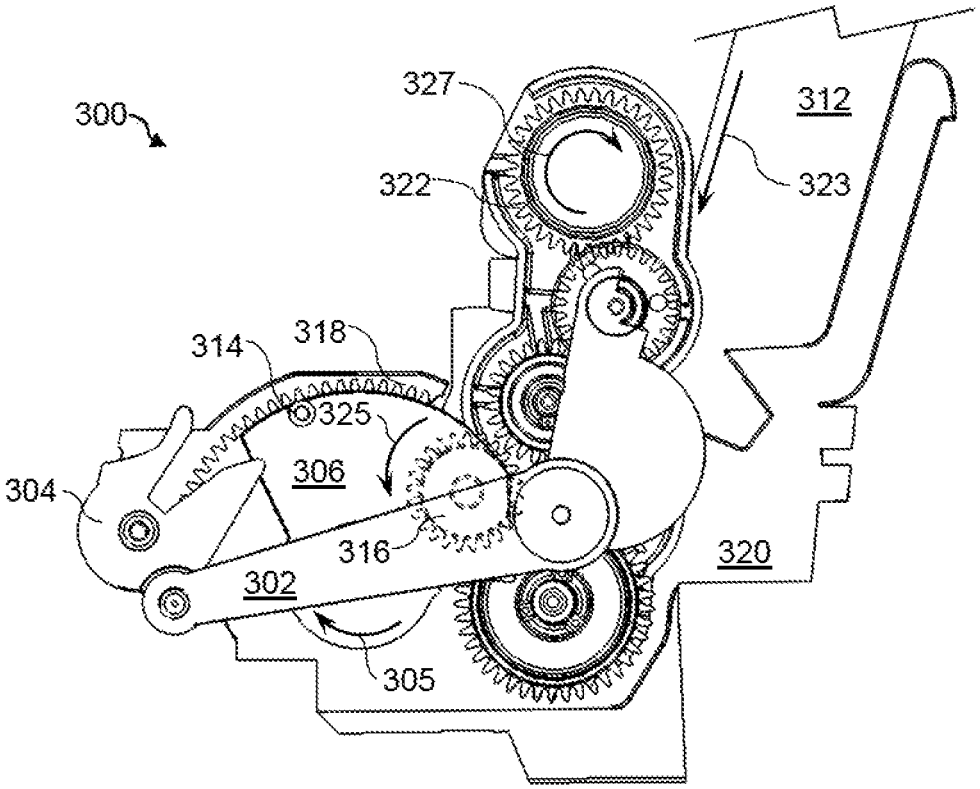
FIG. 3C is a side view of an example lift mechanism.

Referring now to FIG. 3C, a side view of example lift mechanism 300 is illustrated wherein the pick arm 308 is disposed in the lowered position. The planetary gear 316 and the swingarm 306 have moved in the first direction 305 to a degree sufficient to fully transition the crank 304 from the first position to the second position. The crank 304, therefore, has fully transitioned, through the linkage 302, the pick arm 308 from the raised position to the lowered position. Additionally, in some implementations, after moving along first direction 305 to fully transition the pick arm 308 from the raised position to the lowered position, the planetary gear 316 and the swingarm 306 may continue to travel along first direction 305 in order to engage the planetary gear 316 with a gear train 322 of the imaging device. The gear train 322 may be a transmission having a single gear or cog, or include multiple gears or cogs, in some implementations. The gear train 322, in some implementations, may include components that engage each other through friction, instead of through meshing teeth. In further implementations, the gear train may be disposed on or within, or otherwise be connected to the pick arm 308. The gear train 322 may be operably engaged with a pick roller or multiple pick rollers, or other picking components of the pick arm 308, such that the gear train drives the pick components in order to pick media 312. In further implementations, once engaged with the gear train, the drive element may continue to rotate the planetary gear in direction 325 in order to operably drive the gear train so that a pick tire or pick component of the pick arm 308 may rotate in a picking direction 327 to pick media 312 and deliver the media 312 through a media path 323 of the imaging device.

In addition to rotating the swingarm 306 along first direction 305, the planetary gear 316 may also rotate the swingarm 306 in a second direction, opposite to direction 305, in order to move the crank 304 from the second position to the first position. The drive element may rotate the planetary gear 316 in a direction opposite to direction 325 such that the planetary gear 316 moves along the ring gear 318 in the second direction, and therefore moves the swingarm 306 in the second direction.

Figure 4:
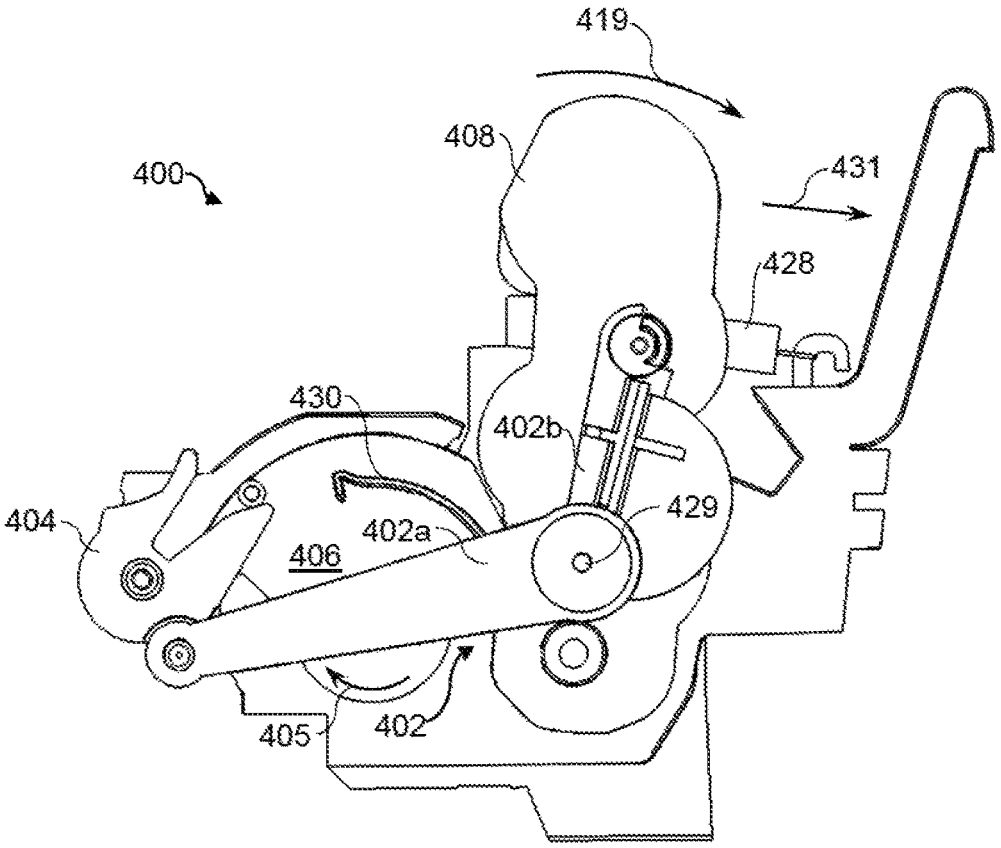
FIG. 4 is a side view of an example lift mechanism.

Referring now to FIG. 4, a side view of an example lift mechanism 400 of an imaging device is illustrated. Example lift mechanism 400 may be similar to example lift mechanism described above. Further, the similarly named elements of example lift mechanism 400 may be similar in function and/or structure to the elements of other example lift mechanisms, as they are described above. Lift mechanism 400 may engage with a pick arm 408 to transition the pick arm 408 from a raised position to a lowered position along a direction 419, and vice versa. FIG. 4 illustrates the lift mechanism 400, wherein the pick arm 408 is disposed in the lowered position. In some implementations, the lift mechanism 400 may include a linkage 402 connected to the pick arm 408. The linkage 402 may include a first arm 402*a*, and a second arm 402*b*. In some implementations, the first and second anus 402*a* and 402*b* may be movable relative to one another. In further implementations, the second arm 402*b* may be movable relative to the first arm 402*a* along a direction opposite to that of direction 419, and in yet further implementations, the second arm 402*b* may be pivotable about a pivot 429 relative to the first arm 402*a*.

In some implementations, the lift mechanism 400 may further include a bias member 428. The bias member 428 may be a resilient member capable of elastic deformation. In other words, the bias member 428 may be capable of returning to its original structure or shape after being deformed. In some implementations, the bias member 428 may be a spring, and in further implementations, the bias member 428 may be a tension coil spring. In other implementations, the bias member 428 may be another type of spring. The bias member 428 may be engaged with the pick arm 408 and the lift mechanism 400, or another component thereof. The bias member 428 may exert a normal force in response to a deformation that is both oriented opposite to and proportional to the degree of deformation. In further implementations, the bias member 428 may bias, pull, or push the pick arm 408 in a direction 431 towards the lowered position. In some implementations, when the pick arm 408 is disposed in the lowered position, the pick arm 408 may be movable against the exerted force of the bias member 428 towards the raised position, through the movability of the second arm 402*b* relative to the first arm 402*a*. Thus, when in the lowered position, the pick arm 408 may be able to engage with media of differing thickness, or stacks of media with different thicknesses.

In some implementations, the lift mechanism 400 may further include a blocker 430. The blocker 430, in some implementations, may be a rib, wall, shield, or other protrusion, or another feature capable of blocking a crank 404 from movement. In some implementations, the blocker 430 may be disposed on a swingarm 406, and, further, may be a unitary component with the swingarm 406, or may be a separate component attached to the swingarm 406. As such, the blocker 430 may move with the swingarm 406 in a first direction 405 and a second direction. When the crank 404 is in a first position, the swingarm 406, and the blocker 430 thereon, may be disposed relative to the crank 404 such that the crank 404 cannot move to a second position, or, further, may not move out of the first position at all, in some implementations. If an attempt were made to move the crank 404 out of the first position by an outside force, such as an impact, for example, the crank 404 may contact the blocker 430 and be prevented from moving out of the first position, or into the second position. Further, the swingarm 406 may move in the first direction and engage with the crank 404 to move the crank 404 from the first position to the second position. As the swingarm 406 moves along the first direction 405, the blocker 430 may be moved or rotated out of the way such that, as soon as the swingarm 406 starts to move the crank 404 from the first position to the second position, the blocker 430 may no longer prevent the crank 404 from such a transition. It should be noted that FIG. 4 illustrates the crank 404 in the second position, after the swingarm 406 and the blocker 430 have moved along first direction 405, thus moving the blocker 430 out of the way of the crank 404. In some implementations, the blocker 430 may be disposed on another component other than the swingarm 406, and may be moved out of the way of the crank 404 in another way.

Figure 5:
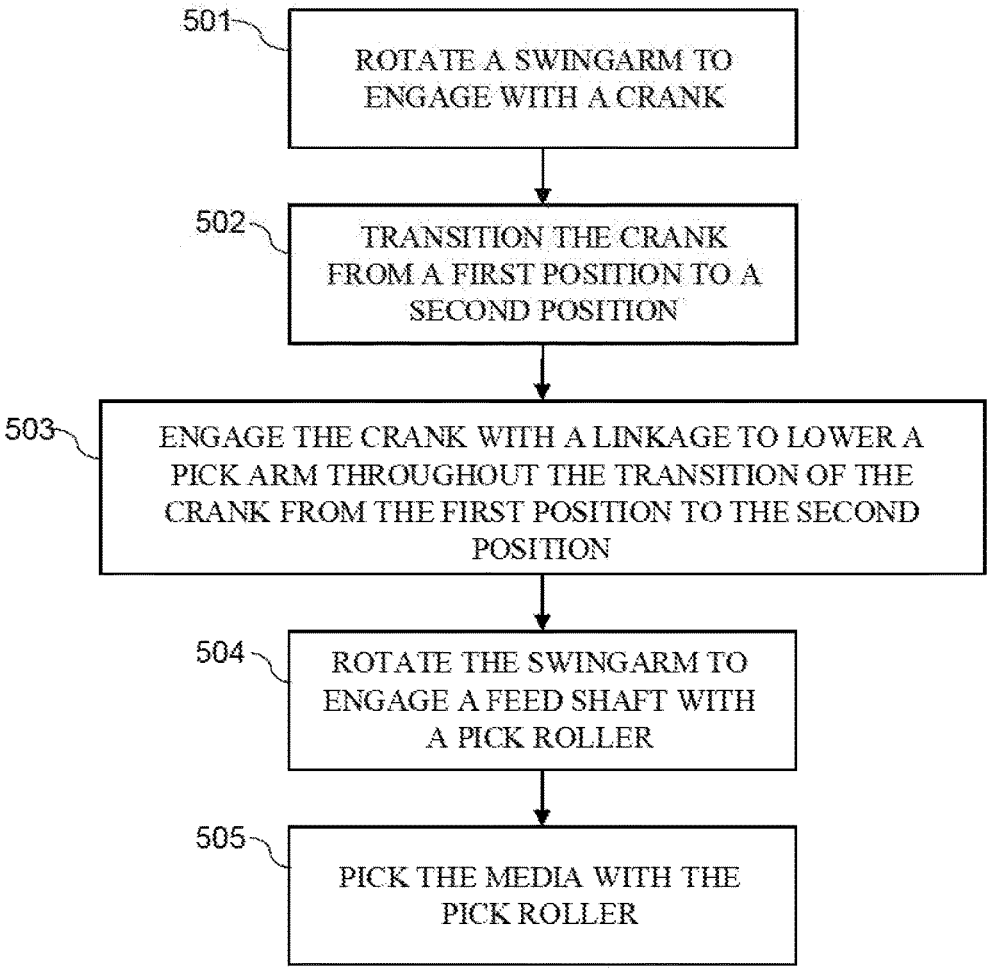
FIG. 5 is a block diagram of a method for picking media.

Referring now to FIG. 5, a method for picking media is illustrated. Block 501 rotates a swingarm to engage with a crank. Block 502 transitions the crank from a first position to a second position. Block 503 engages the crank with a linkage to lower a pick arm throughout the transition of the crank from the first position to the second position. Block 504 rotates the swingarm to engage a feed shaft with a pick roller. In some implementations, the feed shaft may be engaged with a gear train to drive the pick roller. Block 505 picks the media with the pick roller.

What is claimed is:

1. A lift mechanism, comprising:

a linkage to engage with a pick arm;

a crank switchably disposed in a first position and a second position; and a swingarm to move the crank from the first position to the second position, the linkage to move the pick arm from a raised position to a lowered position when the crank moves from the first position to the second position.

2. The lift mechanism of claim 1, wherein the swingarm is to move the crank from the second position to the first position, the linkage to move the pick arm from the lowered position to the raised position when the crank moves from the second position to the first position.

3. The lift mechanism of claim 2, wherein the swingarm comprises a post to engage with a slot of the crank to move the crank from the first position to the second position, and from the second position to the first position.

4. The lift mechanism of claim 3, wherein the post is to engage with the slot to move the crank from the first position to the second position as the post rotates about an axis of the swingarm.

5. The lift mechanism of claim 1, wherein the crank is to lock the pick arm in the raised position when the crank is in the first position, such that the pick arm cannot move to the lowered position.

6. The lift mechanism of claim 1, wherein the pick arm comprises a pick roller to pick media for delivery through a media path of an imaging device when the pick arm is in the lowered position.

7. The lift mechanism of claim 6, wherein the linkage comprises a lower link and an upper link that is movable relative to the lower link when the pick arm is in the lowered position such that the pick arm can pick media of differing thickness.

8. A lift device, comprising:

a pick arm having a pick roller;

a swingarm having a post and driven by a feed shaft in a first direction;

a crank having a slot to receive the post of the swingarm, the post to rotate the crank from a first position to a second position when the swingarm is driven in the first direction; and a linkage to engage the crank with the pick arm, the linkage to dispose the pick arm in a raised position when the crank is in the first position, and to dispose the pick arm in a lowered position when the crank is in the second position.

9. The lift device of claim 8, wherein the swingarm comprises a planetary gear to engage with a stationary ring gear, the planetary gear to move along the ring gear to rotate the crank from the first position to the second position.

10. The lift device of claim 9, wherein the planetary gear is to operably engage with a gear train when the pick arm is in the lowered position, the feed shaft to drive the pick roller through the planetary gear and the gear train.

11. The lift device of claim 9, wherein the swingarm is to be driven by the feed shaft in a second direction, the planetary gear to be driven by the feed shaft to move along the ring gear to rotate the crank from the second position to the first position when the swingarm is driven in the second direction.

12. The lift device of claim 8, further comprising a bias member to bias the pick arm towards the lowered position.

13. The lift device of claim 8, wherein the pick roller is to pick media for delivery through a media path of an imaging device when the pick arm is in the lowered position.

14. A method for picking media, comprising:

rotating a swingarm to engage with a crank;

transitioning the crank from a first position to a second position;

engaging the crank with a linkage to lower a pick arm throughout the transition of the crank from the first position to the second position;

rotating the swingarm to engage a feed shaft with a pick roller; and picking the media with the pick roller.

15. The method of claim 14, further comprising engaging the feed shaft with a gear train to drive the pick roller.

* * * * *